United States Patent [19]

Thomas

[11] Patent Number: 4,610,498

[45] Date of Patent: Sep. 9, 1986

[54] POLARIZED THREADED LAMP BASE

[75] Inventor: Leonard A. Thomas, Garrettsville, Ohio

[73] Assignee: General Electric Company, Schenectady, N.Y.

[21] Appl. No.: 273,736

[22] Filed: Jun. 15, 1981

[51] Int. Cl.[4] ..... H01R 13/642

[52] U.S. Cl. ..... 339/186 R; 339/144 R; 40/18; 362/295; 313/324

[58] Field of Search ..... 339/184 L, 184 T, 186 R, 339/186 T, 144 R, 144 T, 146; 362/295; 40/18; 285/91, 92, 282; 403/320, 326

[56] References Cited

U.S. PATENT DOCUMENTS

| | | | |
|---|---|---|---|
| 902,032 | 10/1908 | Whitney | 313/318 |
| 1,138,293 | 5/1915 | Hubbell | 403/320 |
| 1,881,091 | 10/1932 | Myers | 403/320 |
| 1,932,132 | 10/1933 | Cherry | 403/320 |
| 2,844,979 | 7/1958 | Schiller et al. | 78/49 |
| 3,813,115 | 5/1974 | French | 285/92 |
| 4,341,975 | 7/1982 | Phillipp et al. | 313/324 |

*Primary Examiner*—Gil Weidenfeld
*Assistant Examiner*—Gary F. Paumen
*Attorney, Agent, or Firm*—John P. McMahon; Philip L. Schlamp; Fred Jacob

[57] ABSTRACT

A polarized screw base assuring constant angular orientation of a lamp has a polarizing locator for engaging a stop in a mating socket. The locator consists of a length of metal rod welded lengthwise on the crest of a base thread with multiple spot welds to assure adequate shear strength. The leading end of the locator is formed with a hooked or alternatively with a balled end to achieve a locking effect with the stop in the socket.

6 Claims, 4 Drawing Figures

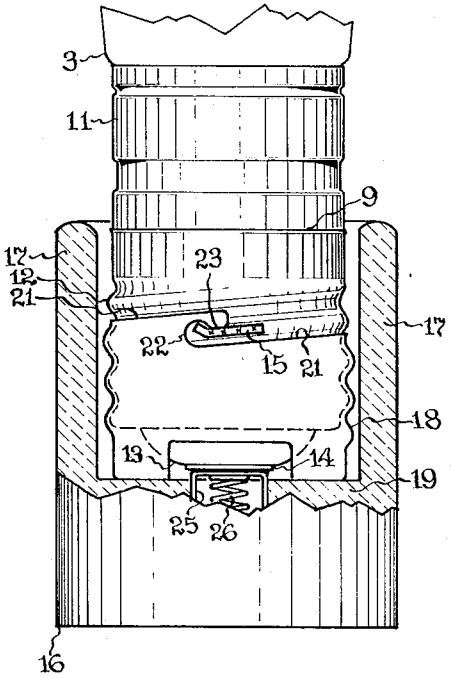
Fig. 2
Fig. 3
Fig. 4
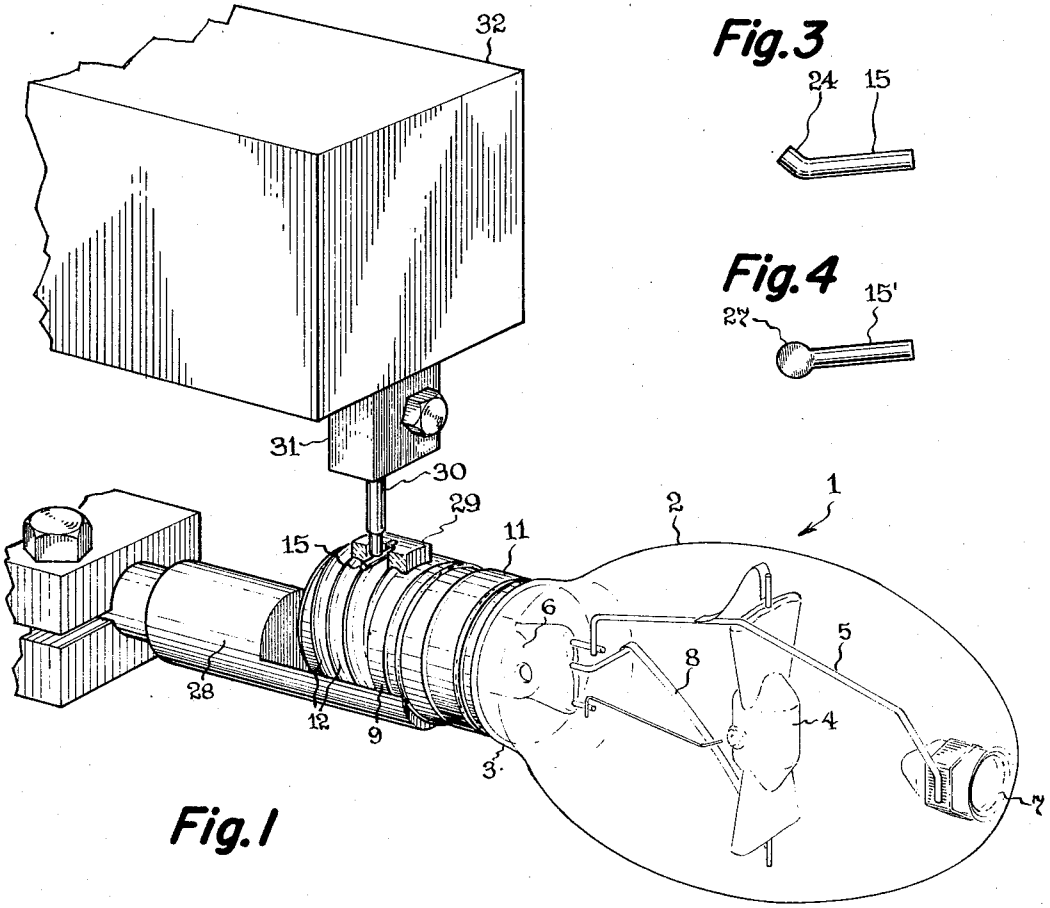
Fig. 1

POLARIZED THREADED LAMP BASE

This invention relates to a polarized threaded lamp base suitable for use with single-ended lamps which are required to have a certain angular orientation in the accommodating socket.

BACKGROUND OF THE INVENTION

Polarized bases are needed with high intensity discharge (HID) lamps in which the arc tube is transversely mounted. HID lamps generally comprise a glass outer envelope or jacket which encloses an arc tube. The jacket has a bulbous or ellipsoidal body portion which is reduced and extended at one end into a tubular neck portion to which is attached the screw-type base for fitting the lamp in a socket.

In metal halide HID lamps, vertical operation of the arc tube is generally the preferred mode for higher efficiency and longer life. In such lamps the discharge is a constricted arc which extends along the axis of the arc tube so long as the arc tube is vertical. If the arc tube is inclined out of the vertical, internal convection currents affect the arc and displace it from the axis. In a horizontal arc tube, the arc is bowed up and may even contact the upper region of the wall, causing it to overheat while the lower extremities of the tube are underheated. The partial overheating results in poor maintenance and shorter life, while the partial underheating reduces the vapor pressure of the metal halides and causes lower efficiency and poor color rendition; tube life and efficiency can be reduced as much as 10 to 15 percent.

While vertical operation of HID lamps having the arc tube axial is most common, there are many installations wherein considerations of space or of convenience and economy require that the outer envelope of the lamp be mounted horizontally. In recent years, and primarily as a result of improvements in color rendition, metal halide lamps have increasingly been used indoors and in applications where ceiling height is limited. Fixtures for such applications mount the lamp horizontally in order to save space and this has increased the demand for metal halide lamps able to operate efficiently in this way. One suitable type of HID lamp is described in U.S. Pat. No. 4,341,975, issued July 27, 1982 of R. G. Phillipp et al and assigned to the same assignee as this invention. In that lamp the arc tube is mounted transversely to the longitudinal axis of the jacket and base. A locator such as a pin or protuberance is provided which protrudes outwardly from the thin-walled metal shell of the base and strikes a stop in the mating socket after the lamp has been screwed in almost fully home. Upon engaging the stop, the pin prevents further rotation of the lamp such that a predetermined uniform orientation, chosen to make the arc tube vertical, is achieved in all sockets. Desirably the pin engages the stop with a locking effect that tends to hold the lamp in place notwithstanding vibration.

The difficulty in providing a locating pin arises from the thinness of the metal wall, usually of brass or aluminum, and the need to have enough strength and shear resistance in the pin that it is not broken off when turned hard against the stop. Merely welding a pin on the crest of the thread does not provide enough strength. One way of achieving adequate strength is to drill a hole through the crest of the thread of the base, place a locating pin within the hole so that it extends outwardly, and then silver-solder the pin in the hole from the inside of the lamp base. Such a method is complicated and expensive from a manufacturing standpoint and also must be performed before the lamp base is attached to the outer envelope of the lamp. Another way described in copending application Ser. No. 236,595 filed Feb. 20, 1981 by H. G. Peters and assigned like this application is to weld a pin onto the crest of a thread and then form a solder fillet around the pin to provide the requisite strength and lateral support.

SUMMARY OF THE INVENTION

The object of the present invention is to provide a new and improved threaded base having a locator protruding outwardly from the metal shell. A construction is desired which permits the locator to be affixed to the outside of a base after the base has been attached to the outer envelope or jacket in which the arc tube is mounted. By so doing, the final position of the locator can be altered to compensate for minor variations in the position of the arc tube. The locator must be attached by a method which is economical and adaptable to automated assembly.

In a polarized screw base embodying my invention, the polarizing locator is a length of metal rod which is welded lengthwise on the crest of the base thread. I have found iron rod suitable for welding to a brass base. The attachment is preferably made by multiple spot welds, and the length of the piece of rod and the number of spotwelds determine the shear strength. In a preferred embodiment, the leading end of the piece of rod is formed with a hooked or alternatively with an expanded end in order to achieve a locking effect with the stop in the socket.

DESCRIPTION OF DRAWING

FIG. 1 illustrates pictorially an HID lamp with a transversely mounted arc tube supported in a welding fixture for affixing a locator to the base thereof in accordance with the present invention.

FIG. 2 is a partly sectioned side elevation view through a conventional polarized socket revealing a base with locator embodying the invention.

FIG. 3 is an enlarged detail of a locator pin having a bent end.

FIG. 4 is an enlarged detail of a locator pin having an end formed to a disc shape.

DETAILED DESCRIPTION

Referring to FIG. 1, the HID lamp 1 illustrated comprises an outer envelope or jacket having a bulb portion 2 with reduced diameter tubular neck portion 3 and an internal discharge envelope or arc tube 4. The arc tube depends by a hinge (not illustrated) from a support rod 5 extending the length of the bulb from stem 6 to anchoring dimple 7 in the dome end, and is locked in the transverse attitude by a ribbon hinge connector 8. This mounting arrangement is fully described in copending application Ser. No. 276,878, filed June 24, 1981, of D. C. Knecht assigned to the same assignee as this invention, and incorporated here by reference. A lamp base 9 attached to a cylindrical extender or collar 11 is fastened to the neck 3.

As best seen in FIG. 2, the base comprises threaded metal shell 12, end insulator 13 and eyelet or end contact 14, together with polarizing locator 15. The locator 15 is a length of metal rod, suitably iron or nickel-plated iron when the base shell is brass. It is welded lengthwise to the crest of the base thread, suitably at about the third full crest from the shoulder of the base shell. The welding preferably is made by multiple spot welds so that the length of the piece of rod and the number of spot welds determines the shear strength. I have found that a length of about 1 cm will easily accommodate 4 spot welds and give shear strength fully adequate for the purpose.

The locator performs the same function as a conventional locating pin and assures a predetermined angular orientation of the lamp on its longitudinal axis when the locator is screwed home against the cooperating stop in the socket. In FIG. 2, the base is shown screwed into a socket 16 of which the ceramic walls 17 have been cut open for illustrative purposes. The metal socket shell 18 is fastened to the bottom ceramic wall 19. It is threaded in the same fashion as the lamp base but the threading has not been shaded in to simplify the illustration. There is enough clearance between the side walls 17 and shell 18 to allow the locator 15 to pass through when a base is screwed into the socket. The upper edge 21 of the socket shell is cut along a helix paralleling the threads for slightly more than 1 turn. Where the helical edge laps itself a full turn, a notch 22 is cut into the thread step to serve as a stop for the locator 15.

The notch 22 in the socket shell leaves a downwardly reverting lip 23 protruding back over the lowermost portion of the upper edge 21 of the socket shell. The locator 15 preferably has an upwardly bent or turned leading end 24 as shown in FIG. 3, which rises behind the reverting lip 23. Due to the upward pressure exerted on the base through eyelet connector 25 and its spring 26, the interengagement of upwardly turned end 24 of the locator and reverting lip 23 of the notch produces a locking effect. The locking effect prevents loosening and disengagement of the lamp through vibration or accidental jarring. Instead of a bent end, the locator 15' may have its leading end expanded to a ball or disc shape 27 as shown in FIG. 4.

A convenient set-up or jig for welding the locator to the base shell is illustrated in simplified form in FIG. 1. The lamp base is accommodated in a copper cradling electrode 28 while the lamp is rotated on its longitudinal axis until the arc tube is oriented vertically as shown. An optical system (not shown) providing an enlarged image of the arc tube on a screen may be used as an aid to rapid error-free orientation. A fixture comprising a small block 29 of insulating material such as a phenolic plastic, appropriately grooved on its underside to match the base threads, may be used to hold the locator piece 15 on the crest of the third thread of the base. A slot cut through the block overlies the thread crest and holds the locator piece 15 in place. A central enlargement in the slot permits penetration of a tack or spot welding electrode 30 from above. The block 29 is shown sectioned with one half removed for illustrative purposes in FIG. 1. The welding electrode depends from movable arm or actuator 31 coming out of spot welder 32 through which moderate pressure may be applied on the piece while tack welding. A hinged bracket (not shown) may be used to pivot and locate fixture block 29 on each new lamp base. After the first tack or spot weld has been made, fixture block 29 is swung out of the way and the operator rocks the lamp back and forth in cradling electrode 28 while making the additional spot welds desired. The heat and pressure developed during welding curves the locator piece 15 into conformance with the shell even though the piece may have been a straight pin initially.

The preferred embodiment of the invention and the method and techniques used in making it have been described for illustrative purposes and the scope of the invention is to be limited by the following claims only.

What I claim as new and desire to secure by Letters Patent of the United States:

1. A polarized screw type lamp base comprising a thin-walled threaded metal shell having a bottom insulator attached thereto carrying an end contact, and a locator on said shell protruding outwardly and adapted to engage a stop in a mating socket for achieving a predetermined angular orientation of the lamp base relative to its longitudinal axis, said locator being an elongated piece of metal rod extending in a conformal manner lengthwise along and bonded to a predetermined location of a crest of the thread, said locator being effective for positioning said shell in said predetermined angular orientation when the leading end of said locator engages said stop in said mating socket.

2. A lamp base as in claim 1 wherein the locator is welded to said crest by multiple spot welds in order to have adequate shear strength.

3. A lamp base as in claim 1 wherein the leading end of the locator is upwardly turned relative to the bottom of the base in order to have a locking effect with the stop in the mating socket.

4. A lamp base as in claim 1 wherein the leading end of the locator is laterally expanded in order to have a locking effect with the stop in the mating socket.

5. A lamp base as in claim 1 wherein the shell is brass and the locator is iron rod.

6. A lamp base as in claim 2 wherein said locator is an elongated piece of metal rod having a length of approximately 1.0 centimeter and is secured to said thread by four (4) longitudinally disposed spot welds.

* * * * *